US007698814B2

(12) United States Patent
Buehner

(10) Patent No.: US 7,698,814 B2
(45) Date of Patent: Apr. 20, 2010

(54) METHOD FOR LINEARIZING POTENTIOMETRIC SENSORS

(75) Inventor: Alfons Buehner, Hohenroth (DE)

(73) Assignee: PREH GmbH (DE)

( * ) Notice: Subject to any disclaimer, the term of this patent is extended or adjusted under 35 U.S.C. 154(b) by 237 days.

(21) Appl. No.: 11/892,156

(22) Filed: Aug. 20, 2007

(65) Prior Publication Data

US 2008/0042799 A1 Feb. 21, 2008

(30) Foreign Application Priority Data

Aug. 19, 2006 (DE) ..... 10 2006 039 095

(51) Int. Cl.
*H01R 43/00* (2006.01)

(52) U.S. Cl. ..... 29/884; 29/593; 29/620; 338/174; 338/195

(58) Field of Classification Search ..... 29/620, 29/593, 884; 338/195, 174
See application file for complete search history.

(56) References Cited

U.S. PATENT DOCUMENTS 3,821,845 A * 7/1974 Hukee et al. ..... 29/593

4,032,881 A * 6/1977 Singleton ..... 338/195

* cited by examiner

*Primary Examiner*—Derris H Banks
*Assistant Examiner*—Azm Parvez
(74) *Attorney, Agent, or Firm*—Cantor Colburn LLP

(57) ABSTRACT

A method for linearizing potentiometric sensors is provided, the method can include the steps of: insertion in a measurement and/or processing station of a potentiometric sensor provided with a resistive track; application of a defined voltage and/or of a defined current across the resistive track; placement of a number of sensing elements composed of metallic contacts distributed at uniform intervals over the length of the resistive track; acquisition of the individual measured values of the sensing elements and determination of the curve of the resistance of the resistive track, and linearization of the resistance of the resistive track by means of sequential adjustment of the resistance of the resistive track. A means for marking the contact points of the sensing elements is placed on the resistive track prior to the placement of the sensing elements, and then the sensing elements are placed on the means, and the means are removed once the contact points of the sensing elements have been marked, and the position of the contact points of the sensing elements is taken into account in determining the curve of the resistance of the resistive track.

5 Claims, 2 Drawing Sheets

METHOD FOR LINEARIZING POTENTIOMETRIC SENSORS

This nonprovisional application claims priority under 35 U.S.C. §119(a) to German Patent Application No. DE 102006039095, which was filed in Germany on Aug. 19, 2006, and which is herein incorporated by reference.

BACKGROUND OF THE INVENTION

1. Field of the Invention

The present invention relates to a method for linearizing potentiometric sensors which comprises the steps of: insertion in a measurement and/or processing station of a potentiometric sensor provided with a resistive track; application of a defined voltage and/or of a defined current across the resistive track; placement of a number of sensing elements composed of metallic contacts distributed at uniform intervals over the length of the resistive track; acquisition of the individual measured values of the sensing elements and determination of the curve of the resistance of the resistive track; and linearization of the resistance of the resistive track by means of sequential adjustment of the resistance of the resistive track.

2. Description of the Background Art

Potentiometric sensors are frequently used where continuous adjustment of a setpoint value is needed or where a measured value is to be linearly acquired over an angle, for example, in order to sense the motion of a brake lever. Such rotary resistors or potentiometers or potentiometric sensors are known in a design in which metallic contacts are applied to a plastic substrate as conductive traces, between the input and output of which is printed a resistive track on the plastic printed circuit board, for example over an angular range. A wiper, by means of which the variable resistance on the resistive track can be adjusted and tapped, then runs over this resistive track. A wide variety of methods for linearizing the resistance of the resistive track on the printed circuit board have been disclosed.

A potentiometric sensor with a resistance applied over an angular range is known from U.S. Pat. No. 4,032,881. The potentiometric sensor has metallic contact areas at its input and output, between which is applied to a printed circuit board a resistive track extending over approximately 270°. To linearize the curve of the resistance over the circumference of the resistive track, contacts that stand in electrical contact with the resistive track are applied to a carrier at regular circumferential intervals adjacent to the resistive track. In this regard, sensing elements that are applied to the contacts distributed over the circumference determine the curve and the linearity of the resistance over the circumference so that trimming of the linearity can take place. Trimming here takes place by the means that radial notches are introduced in the resistive track by a laser, resulting in an increase in the resistance. By these radial notches, it is possible to linearize the curve of the resistance over the circumference.

Another method for linearizing potentiometric sensors is known from U.S. Pat. No. 3,821,845. Here, linearization takes place by a device equipped with sensing elements distributed over its circumference is brought over and onto the resistive track, so that the curve of the resistance over the resistive track can be sensed at discrete points. Once again, trimming is accomplished by a laser, wherein parallel radial notches are introduced into the resistive track.

A disadvantage of the methods for linearizing potentiometric sensors known from prior art is that inaccurate tapping results in errors in the trimming of the resistive track. In this regard, it can be established as inaccurate sensing that a displacement of the sensing element of as little as 0.2% during placement on the resistive track results in errors or deviations of 2% in the resistance. Such measurement methods and methods for linearization are unsuitable to meet today's stringent requirements in, e.g., the automotive industry, since their tolerance ranges lie outside the requirements demanded by the automotive industry. The above-described potentiometric sensors known from the prior art are thus unsuitable for use in a motor vehicle, for example for sensing the position of a brake pedal.

SUMMARY OF THE INVENTION

It is therefore an object of the present invention to provide a method with which much greater accuracies can be achieved in linearizing and trimming resistive tracks. It is also the object of the invention to provide a cost-effective and easily reproducible method.

The object is attained according to the invention in that a marker for marking the contact points of the sensing elements is placed on the resistive track prior to the placement of the sensing elements, then the sensing elements are placed on the marker, and the markers are removed once the contact points of the sensing elements have been marked, and in that the position of the contact points of the sensing elements is taken into account in determining the curve of the resistance of the resistive track. Through the inventive marking of the contact points of the sensing elements and their mathematical incorporation in calculating the positions of the sensing elements on the resistive track, inaccuracies in the position of the very fine sensing elements can be eliminated. The precise determination of the positions of the sensing elements on the resistive track makes it possible to perform much more precise linearization of the resistive track.

A means for marking the resistive track is, for example, carbon paper. When carbon paper is used, bringing the sensing elements into contact with the carbon paper and pressing them against the resistive track makes markings visible on the resistive track, the positions of which are subsequently measured manually or automatically with a laser; the measured and stored marking points are taken into account in calculating the trimming of the resistive track. In this process, the marked or identified contact points on the resistive track are optoelectronically measured, stored and taken into account in the algorithm for trimming the resistive track. The positions of the marked or identified contact points are measured very accurately with the aid of a laser system, thus identifying the actual position of the probe, which is to say the sensing element. Using the knowledge of the actual positions and the precise voltage drops between these positions, the voltage drop per increment of angle or distance can be calculated. The voltage drops calculated for the different increments, which is to say the spacings between the sensing elements on the resistive track, are compared and the maximum voltage drop is established as the target gradient. All other gradients are now matched to the maximum gradient by means of a laser.

Trimming by means of the method for linearizing is explained below on the basis of an example embodiment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
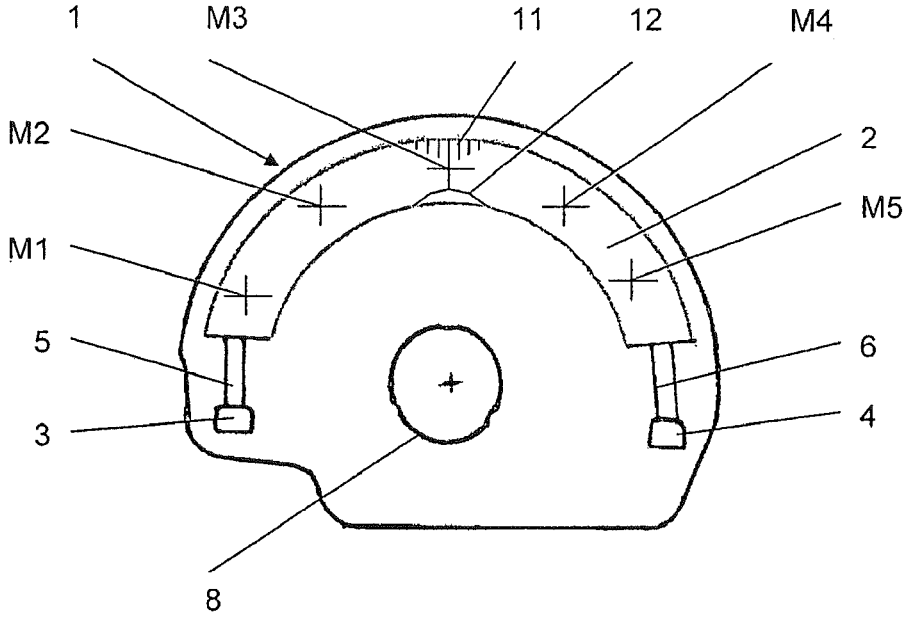
FIG. 1 is a top view of a potentiometric sensor.

FIG. 1 shows a top view of a potentiometric sensor 1 with a resistive track 2 that can be contacted through electrical terminals 3, 4. The electrical terminals 3, 4 here are connected to the resistive track 2 by traces 5, 6 that are placed on a circuit board 7 carrying the resistive track 2. This potentiometric sensor 1 shown here is known in general and is used where an angle measurement is needed, for example. To this end, the opening 8 of the sensor 1, which is provided with raised portions, is pushed onto, e.g., an axle in a nonrotating manner and is fastened. A movable component to which a wiper is fastened then moves over the resistive track 2, which in this example embodiment covers an angle of approximately 180°. The resistive track is either printed on, chemically applied to, or deposited by means of physical vapor deposition on the circuit board 7. The circuit boards 7 that are used are generally known under the designations FR4, Araldite or laminated paper.

Figure 2:
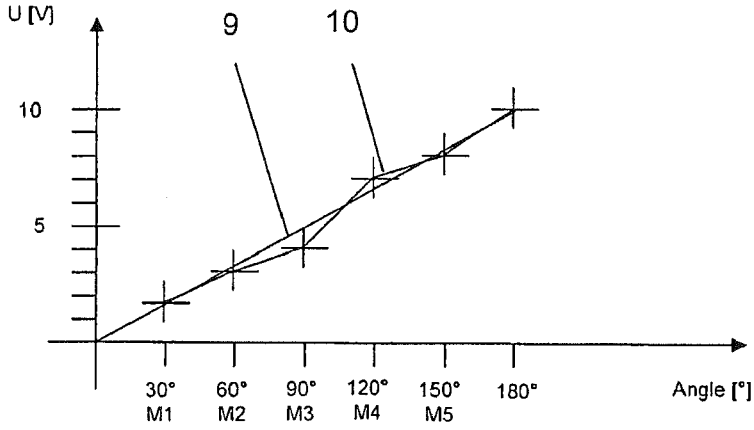
FIG. 2 is a diagram representing the curve of voltage over the angle of the resistive track of the potentiometric sensor from FIG. 1.

If a voltage of, e.g., 10 V is applied to the contacts 3, 4, and a current of 0.1 A flows, the result in the ideal case is an ideal voltage curve 9 such as is shown in FIG. 2. However, the real curve of the measurement points M1, M2, M3, M4, M5 measured by optoelectronic means produces a curve that deviates from the ideal linear line 9 and is plotted with the line 10 in the diagram in FIG. 2 by way of example. The measured value M3, which in this example embodiment is at approximately 90°, results in a voltage value that would be 5V in the ideal case, but is actually 4.5 V. This has the result that the real resistance at measurement point M3 is too small and that this resistance must be increased, in other words that the resistive track must be narrowed. The narrowing or trimming is customarily done by means of a laser as is described in the prior art. According to and example embodiment of the invention, at least two different methods can be chosen for laser trimming.

It should be noted that this is merely an example embodiment sketched in very general terms; in a real measurement, approximately 13 sensing elements are placed on a resistive track 2 over an angle of approximately 125°. For a suitable number of sensing elements, for example 14 sensing elements over 125°, a resolution of 8.9° results. It should be mentioned in this case that a dual-track application of the method is also possible. Thus, two resistive tracks arranged parallel to one another can be trimmed. Trimming a single resistive track over an angle of 125° takes approximately 4 seconds. A resistive track 2 with a length of 50° to 60° requires a period of 2 to 3 seconds for linearization. The dual-track method, in which two parallel resistive tracks are trimmed, requires times of 7 to 8 seconds.

The first method is radial trimming, in which a special algorithm is used to establish a constant gradient over the entire resistive track without distortion of the microlinearity by means of radial notches, such as are shown in FIG. 1 with the radial lines 11. The resolution achievable with this method is $\geqq 1°$.

A second method of laser trimming is continuous trimming. By means of a special algorithm, a constant gradient is established over the entire resistive track 2 without distortion of the microlinearity by means of a continuous cut, such as is shown in FIG. 1 with the line 12. The resolution achievable here is $\geqq 0.35°$. In each of the two methods, a trimming, i.e. a linearization, of the resistive track 2 is accomplished by increasing the resistance, by which means the shape of the curve 10 approaches the ideal shape of the line 9 in the diagram in FIG. 2.

The stringent requirements of industry, and in particular those of the automotive industry, on the linearity of such potentiometric sensors 1 can only be met when the exact positions of the sensing elements are determined before the trimming or laser trimming of the resistive track 2. A deviation of the very fine sensing elements, which are separated from one another by a few millimeters, can only be achieved by the means that the positions of the sensing elements in a fixture are measured relative to the inserted sensor 1 and are taken into account in calculating the curve of the resistance over the resistive track 2. An advantage results here from the fact that continuous trimming of the resistive track 2 permits much more precise trimming.

It remains to be noted that not only is it possible to match the shape of the measured value curve 10 to the ideal shape of the line 9 by raising the resistance of one measured value at a discrete point, it is also possible to match a measured value that lies above the ideal curve by increasing the total resistance of the resistive track 2. The spacing of the sensing elements, and thus the number of sensing elements and the resulting number of measured values, depends on the size of the resistive track, wherein it is of course possible to achieve better matching to the linearity curve with a larger number of sensing elements.

Figure 3:
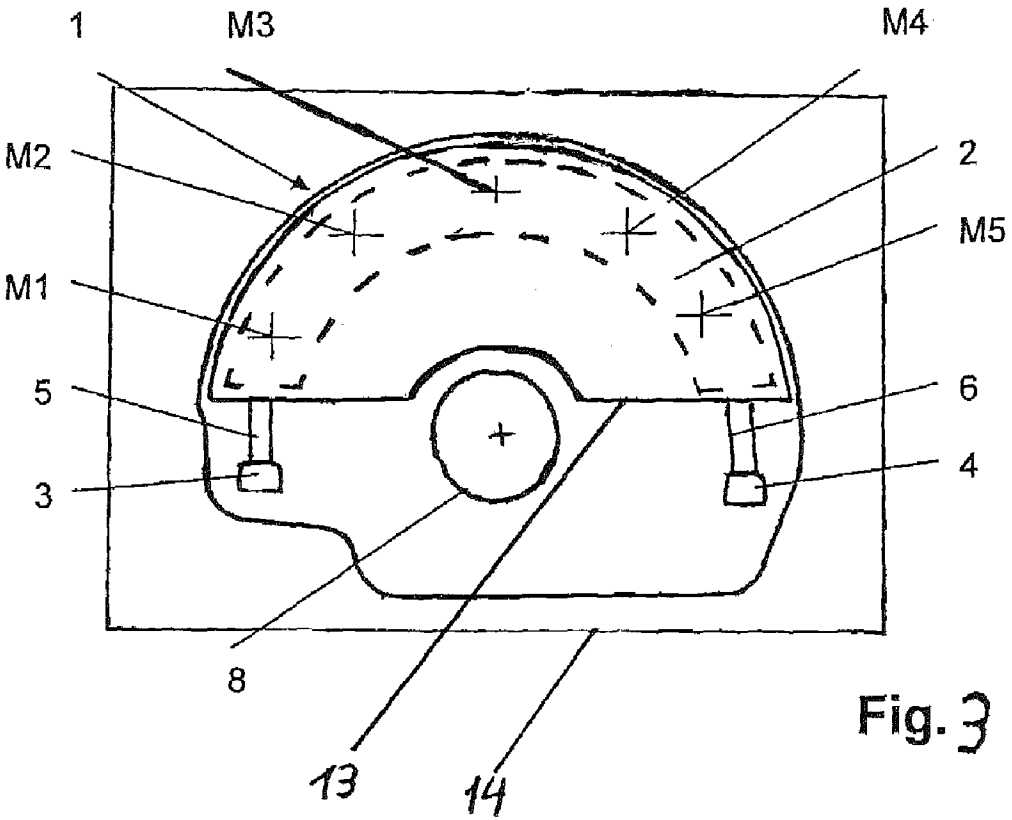
FIG. 3 is a top view of the potentiometric sensor inserted in a processing station.

With reference to FIG. 3, a processing station 14, in which the potentiometric sensor 1 is inserted, is illustrated. Carbon paper 13 is also illustrated.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for linearizing potentiometric sensors, the method comprising: inserting a potentiometric sensor provided with a resistive track in a measurement or processing station; applying a defined voltage or of a defined current across the resistive track; placing sensing elements composed of metallic contacts that are distributed at uniform intervals over the length of the resistive track; acquiring individual measured values of the sensing elements and determining a resistance curve of the resistive track; linearizing the resistance of the resistive track by a sequential adjustment of the resistance of the resistive track; marking, via a marker, contact points of the sensing elements on the resistive track prior to the placement of the sensing elements; placing the sensing elements on the markers; and removing the markers once the contact points of the sensing elements have been marked, wherein a position of the contact points of the sensing elements is taken into account in determining the curve of the resistance of the resistive track.

2. The method according to claim 1, wherein a carbon paper is used as the marker.

3. The method according to claim 1, wherein linearization is accomplished by a removal of the resistive track with a laser.

4. The method according to claim 1, wherein the resistive track is removed continuously and/or in sections, and wherein the linearity of the curve of the resistance is trimmed to $\geqq 35°$.

5. The method according to claim 1, wherein the resistive track is removed sequentially by radial notches, and wherein the linearity of the curve is trimmed to $\geqq 1°$.

* * * * *